US007543469B1

(12) United States Patent
Tseng et al.

(10) Patent No.: US 7,543,469 B1
(45) Date of Patent: Jun. 9, 2009

(54) MECHANISM OF ELECTRONIC DOOR LOCK

(75) Inventors: Chung-Ming Tseng, Taichung (TW); Tien-Chun Lan, Taichung (TW)

(73) Assignee: Sun-Castle Global Precision Technology Co., Ltd., Taichung (TW)

( * ) Notice: Subject to any disclaimer, the term of this patent is extended or adjusted under 35 U.S.C. 154(b) by 0 days.

(21) Appl. No.: 12/078,845

(22) Filed: Apr. 7, 2008

(51) Int. Cl.
*E05B 47/00* (2006.01)

(52) U.S. Cl. ..... 70/472; 70/149; 70/189; 70/218; 70/223; 70/224; 70/277; 70/278.7; 292/142; 292/144; 292/DIG. 27

(58) Field of Classification Search ..... 70/149, 70/188, 189, 472, 422, 218, 222–224, 277, 70/278.1, 278.7, 279.1, 280–283; 292/142, 292/144, 358, 359, DIG. 27
See application file for complete search history.

(56) References Cited

U.S. PATENT DOCUMENTS

| | | | | | |
|---|---|---|---|---|---|
| 3,939,679 | A * | 2/1976 | Barker et al. | ..... | 70/277 |
| 4,073,527 | A * | 2/1978 | Schlage | ..... | 292/347 |
| 4,438,962 | A * | 3/1984 | Soloviff et al. | ..... | 292/144 |
| 6,053,019 | A * | 4/2000 | Wiik et al. | ..... | 70/283 |
| 6,062,612 | A * | 5/2000 | Lin | ..... | 292/144 |
| 6,145,353 | A * | 11/2000 | Doucet | ..... | 70/277 |
| 6,647,753 | B2 * | 11/2003 | Engler | ..... | 70/472 |
| 6,807,834 | B2 * | 10/2004 | Tsai | ..... | 70/472 |
| 6,845,642 | B2 * | 1/2005 | Imedio Ocana | ..... | 70/277 |
| 7,221,272 | B2 | 5/2007 | Hosselet | | |
| 2001/0018837 | A1 * | 9/2001 | Imedio Ocana | ..... | 70/422 |
| 2002/0144526 | A1 * | 10/2002 | Ming-Chih | ..... | 70/218 |
| 2003/0071471 | A1 * | 4/2003 | Lu | ..... | 292/144 |
| 2003/0094023 | A1 * | 5/2003 | Emiel Van Parys | ..... | 70/257 |
| 2003/0150248 | A1 * | 8/2003 | Wu et al. | ..... | 70/224 |
| 2004/0003633 | A1 * | 1/2004 | Alexander et al. | ..... | 70/277 |
| 2004/0040353 | A1 * | 3/2004 | Yu et al. | ..... | 70/107 |
| 2006/0150694 | A1 * | 7/2006 | Frolov et al. | ..... | 70/277 |
| 2006/0254328 | A1 * | 11/2006 | Pearson | ..... | 70/218 |
| 2007/0137267 | A1 * | 6/2007 | Pilatowicz et al. | ..... | 70/107 |
| 2007/0169525 | A1 * | 7/2007 | Chang | ..... | 70/472 |

* cited by examiner

*Primary Examiner*—Lloyd A Gall
(74) *Attorney, Agent, or Firm*—Birch, Stewart, Kolasch & Birch, LLP

(57) ABSTRACT

An electronic lock includes a mechanism comprising a drive assembly comprising a pinion, a gearwheel including a peripheral flange having openings with a curved edge; a clutch comprising a ring including risers in the openings to engage with the curved edges, a first sleeve in the ring and including a rear projection, a driven member including a groove disengaged from the corresponding projection when the lock is locked, and a first spindle, and a spring put on the first sleeve and urged against the driven member; a second sleeve securely urged against the first sleeve; and a second spindle securely passing the second sleeve into the first sleeve. Turning the pinion will turn the gearwheel, push the risers rearward by sliding along the curved edges, move the ring rearward to fit the projection into the groove, and compress the spring such that turning an outer handle will unlock the lock.

4 Claims, 8 Drawing Sheets

MECHANISM OF ELECTRONIC DOOR LOCK

BACKGROUND OF THE INVENTION

1. Field of Invention

The invention relates to locks and more particularly to a mechanism of an electronic door lock with improved characteristics.

2. Description of Related Art

Conventionally, locks are mechanical locks. Recently, electronic door locks are becoming increasingly popular. There have been numerous suggestions in prior patents for electronic lock. For example, U.S. Pat. No. 7,221,272 discloses an electronic lock module. Thus, continuing improvements in the exploitation of electronic lock are constantly being sought.

SUMMARY OF THE INVENTION

It is therefore one object of the invention to provide an electronic lock comprising an outer handle, an inner handle, and a mechanism comprising a housing; a drive assembly disposed in the housing and comprising a gearwheel including a front peripheral flange and a plurality of equally spaced openings around the flange, each opening having a curved edge between the front end of the flange and the teeth of the gearwheel; a clutch disposed in the housing and comprising a ring including a plurality of equally spaced risers, the risers being disposed in the openings to engage with the curved edges, a first bearing sleeve disposed in the ring and including a central opening of a predetermined section and a rear projection of a predetermined shape, a driven member including a groove on its front surface, the groove having a shape conformed to the predetermined shape of the projection and being disengaged from the projection when the electronic lock is in a locked position, and a rear first spindle of a predetermined section, the first spindle projecting out the housing to secure to the inner handle, and a biasing member put on the first bearing sleeve and urged against the driven member; a second bearing sleeve comprising a rear peripheral flange securely urged against the first bearing sleeve and partially forwardly projecting out of the housing; and a front second spindle of a predetermined section securely passing through the second bearing sleeve into the first bearing sleeve to dispose proximate the bottom of the central opening of the first bearing sleeve; whereby activating the drive source will turn the gearwheel via the pinion, push the risers rearward by sliding along the curved edges, move the ring rearward to fit the projection into the groove, and compress the biasing member such that turning the outer handle will activate the mechanism to unlock the electronic lock.

The above and other objects, features and advantages of the invention will become apparent from the following detailed description taken with the accompanying drawings.

DETAILED DESCRIPTION OF THE INVENTION

Figure 1:
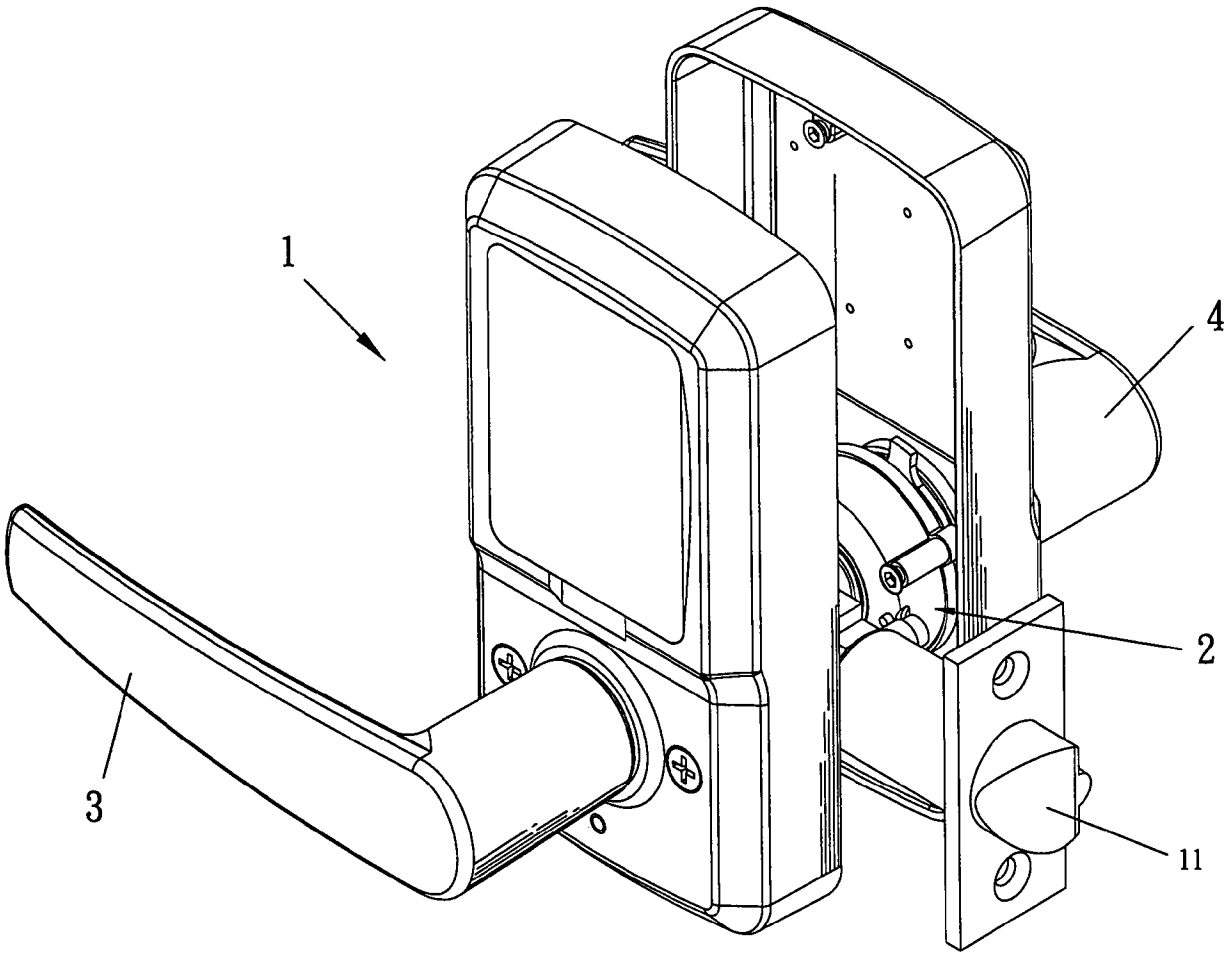
FIG. 1 is a perspective view of a preferred embodiment of electronic lock according to the invention.
Figure 2:
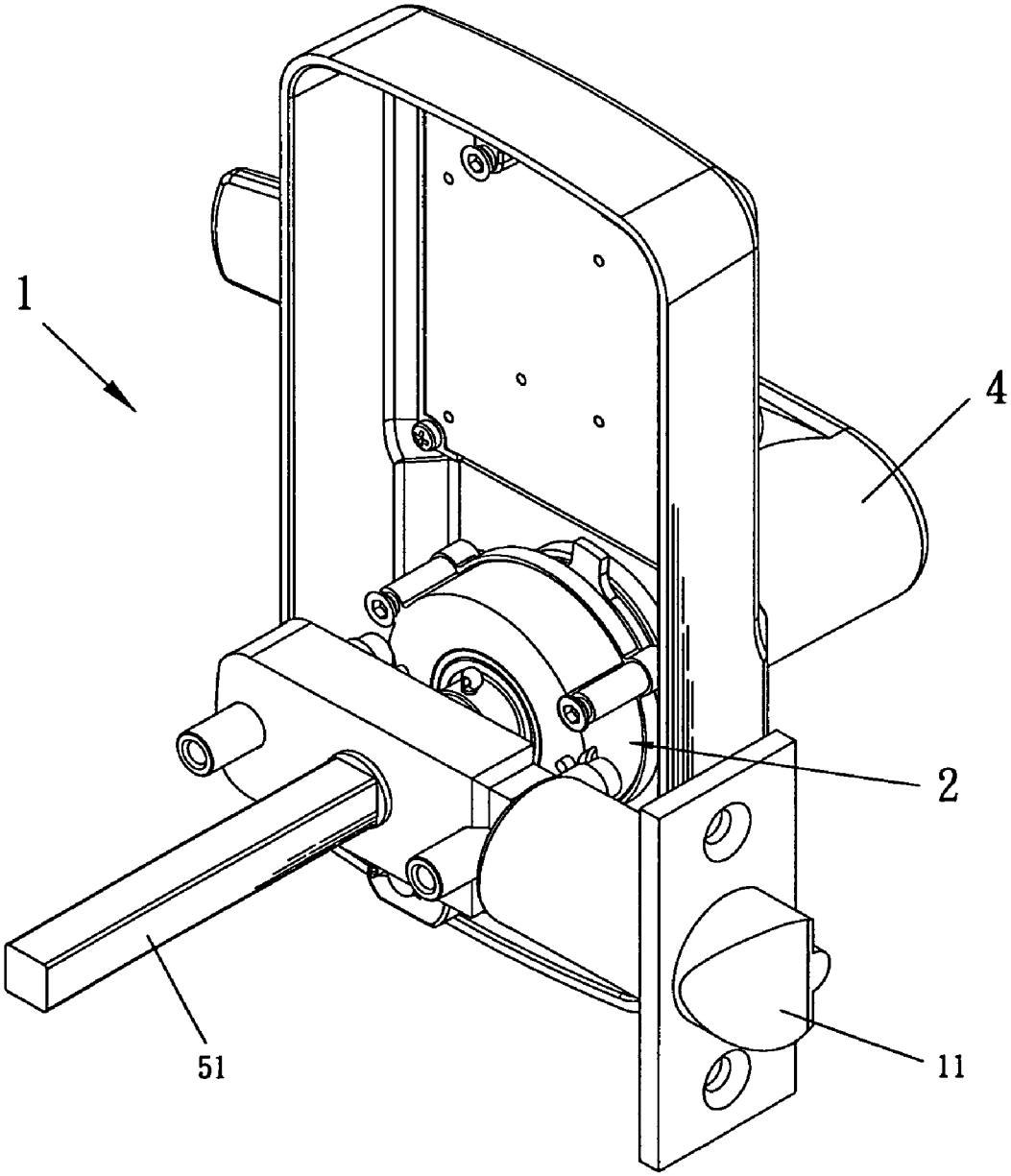
FIG. 2 is a perspective view of the rear portion of the electronic lock with the front portion thereof removed.
Figure 3:
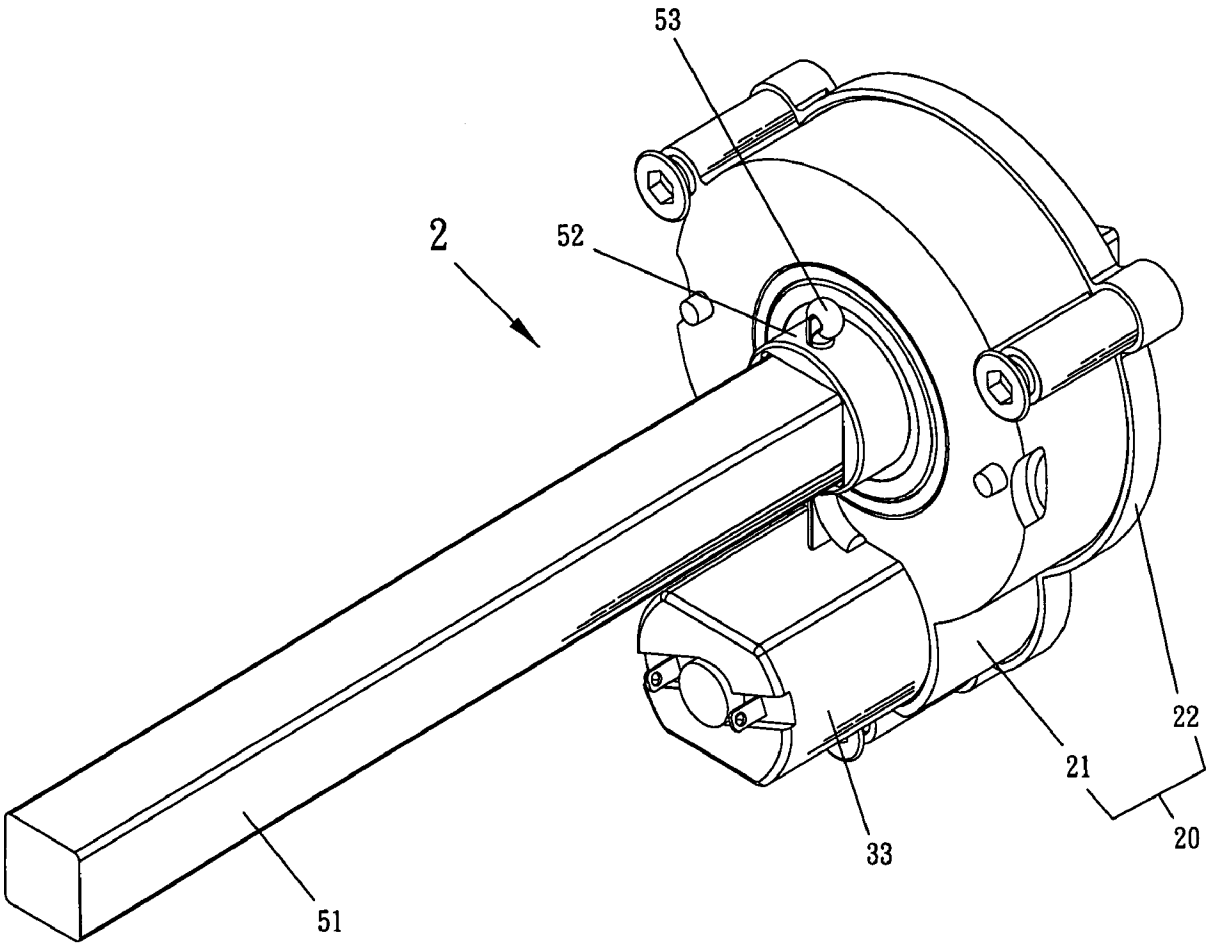
FIG. 3 is a perspective view of the mechanism of the electronic lock.
Figure 4:
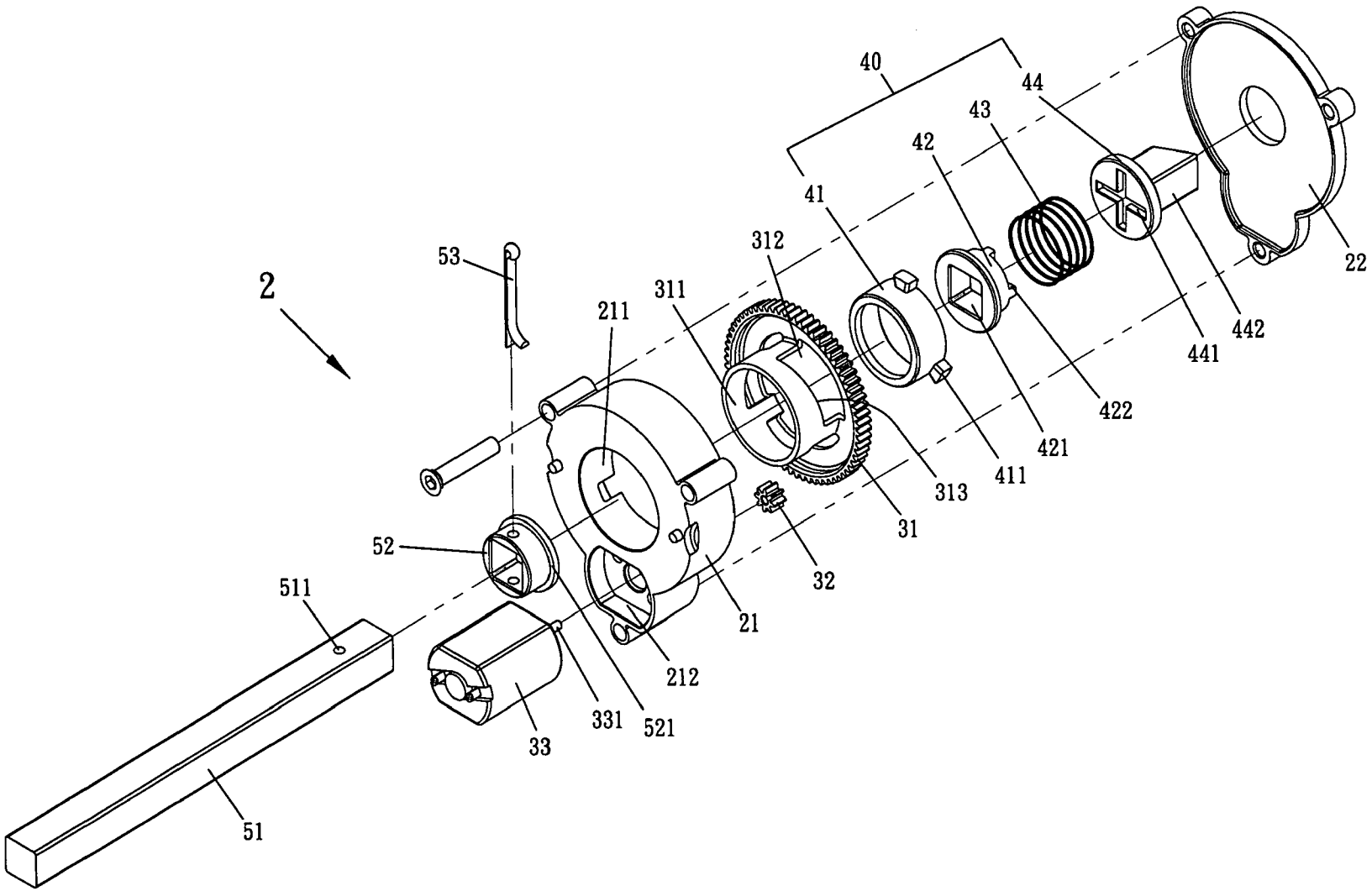
FIG. 4 is an exploded view of the mechanism shown in FIG. 3.
Figure 5:
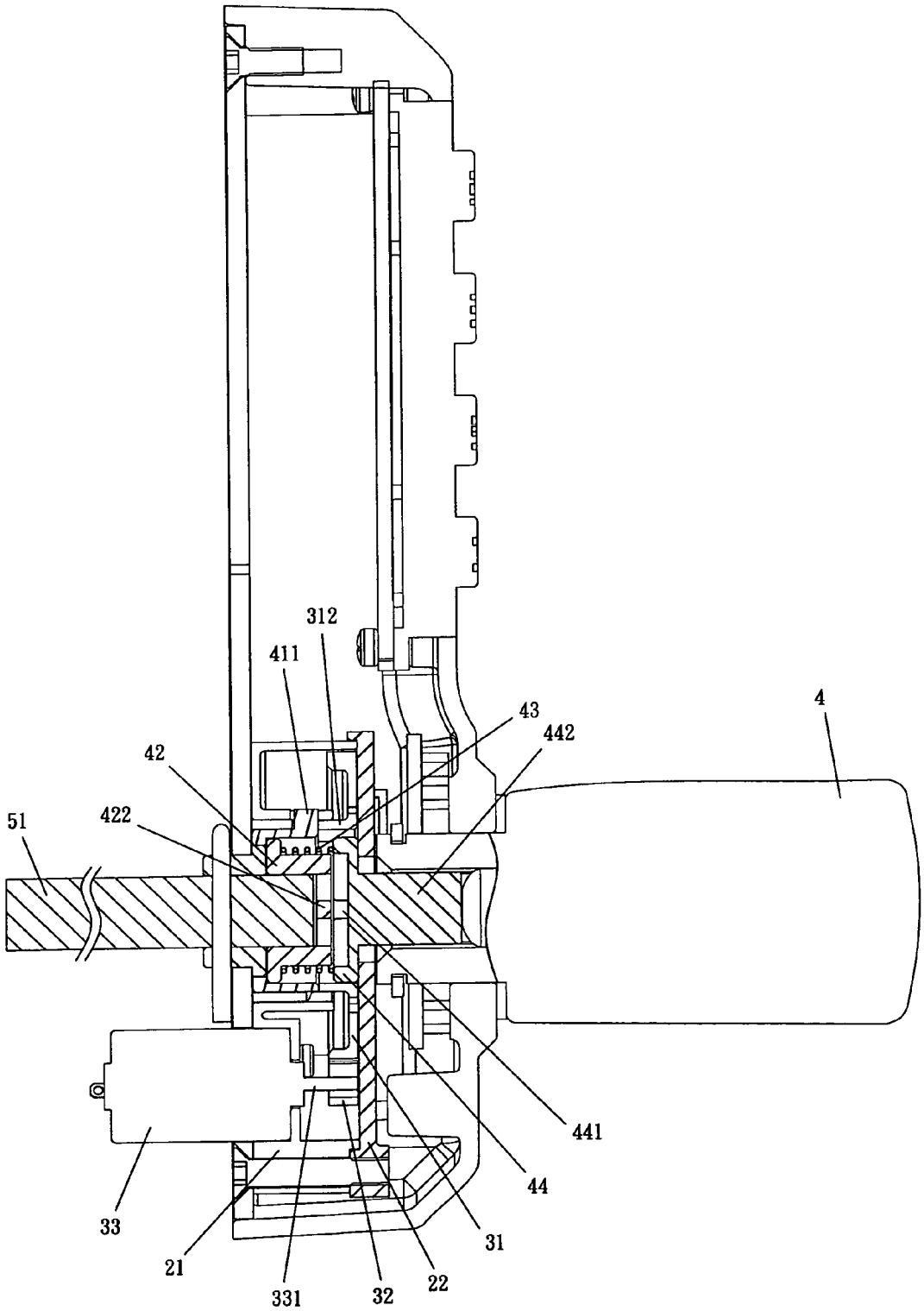
FIG. 5 is a longitudinal sectional view of FIG. 2 with latch bolt and some components removed showing a locked state of the electronic lock.
Figure 6:
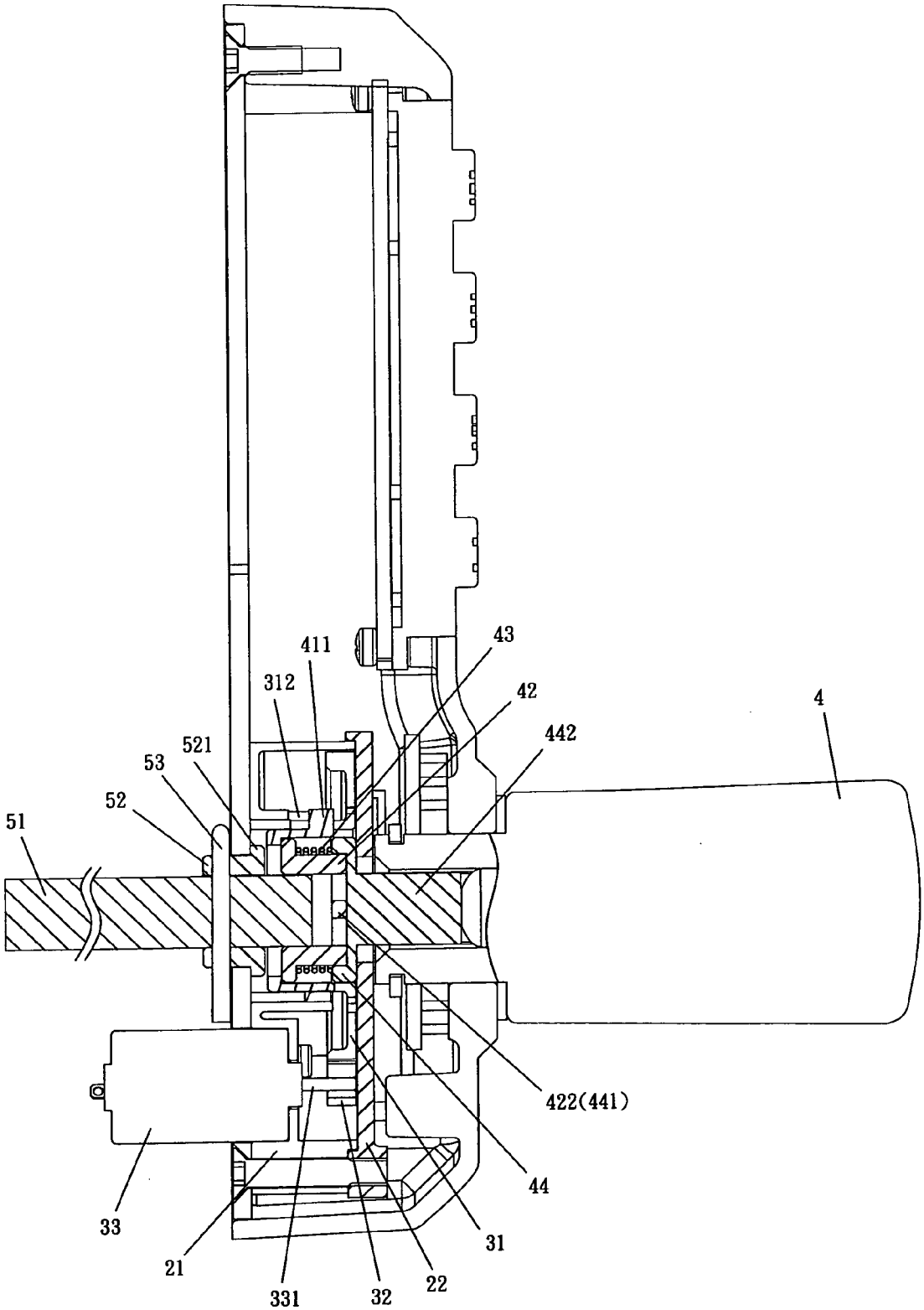
FIG. 6 is a view similar to FIG. 5 showing an unlocked state of the electronic lock.
Figure 7:
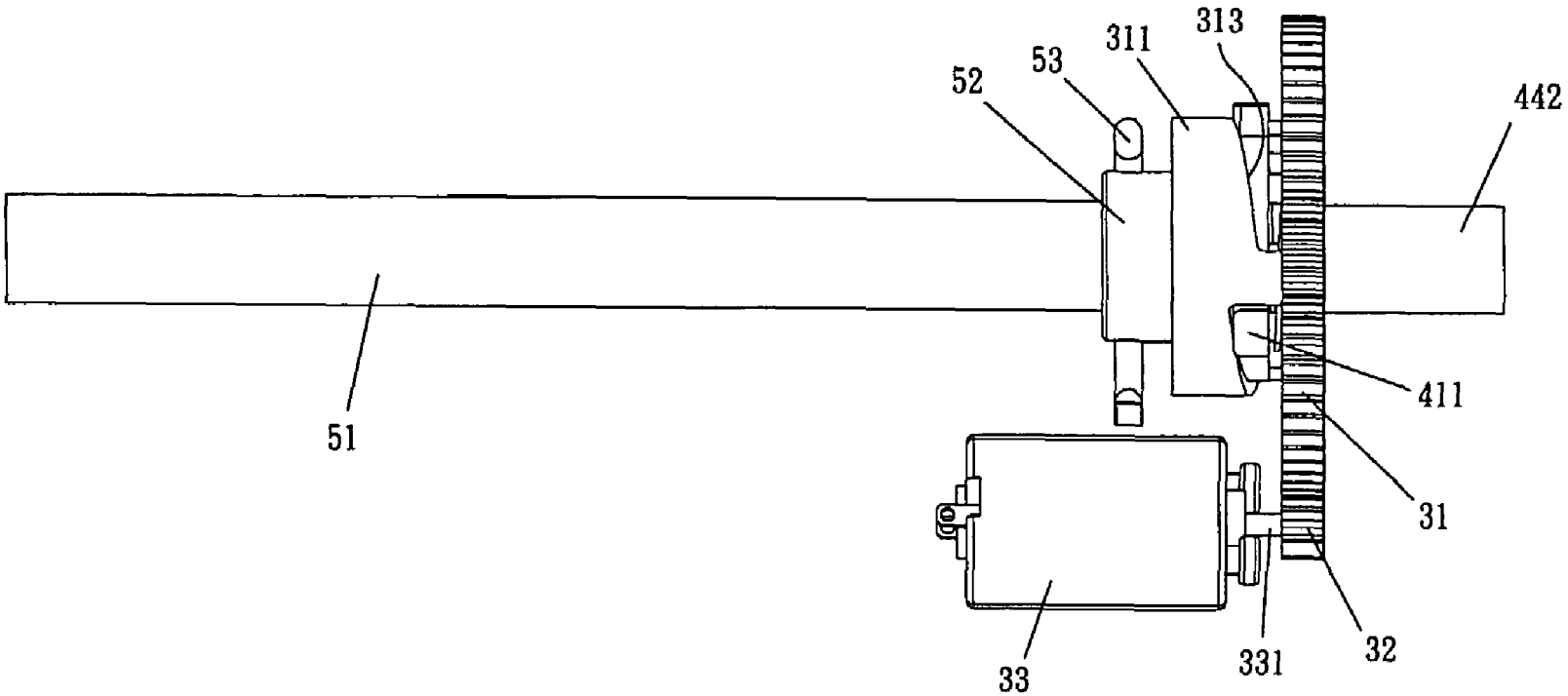
FIG. 7 is a side elevation of FIG. 3 schematically showing the mechanism being in a locked state.
Figure 8:
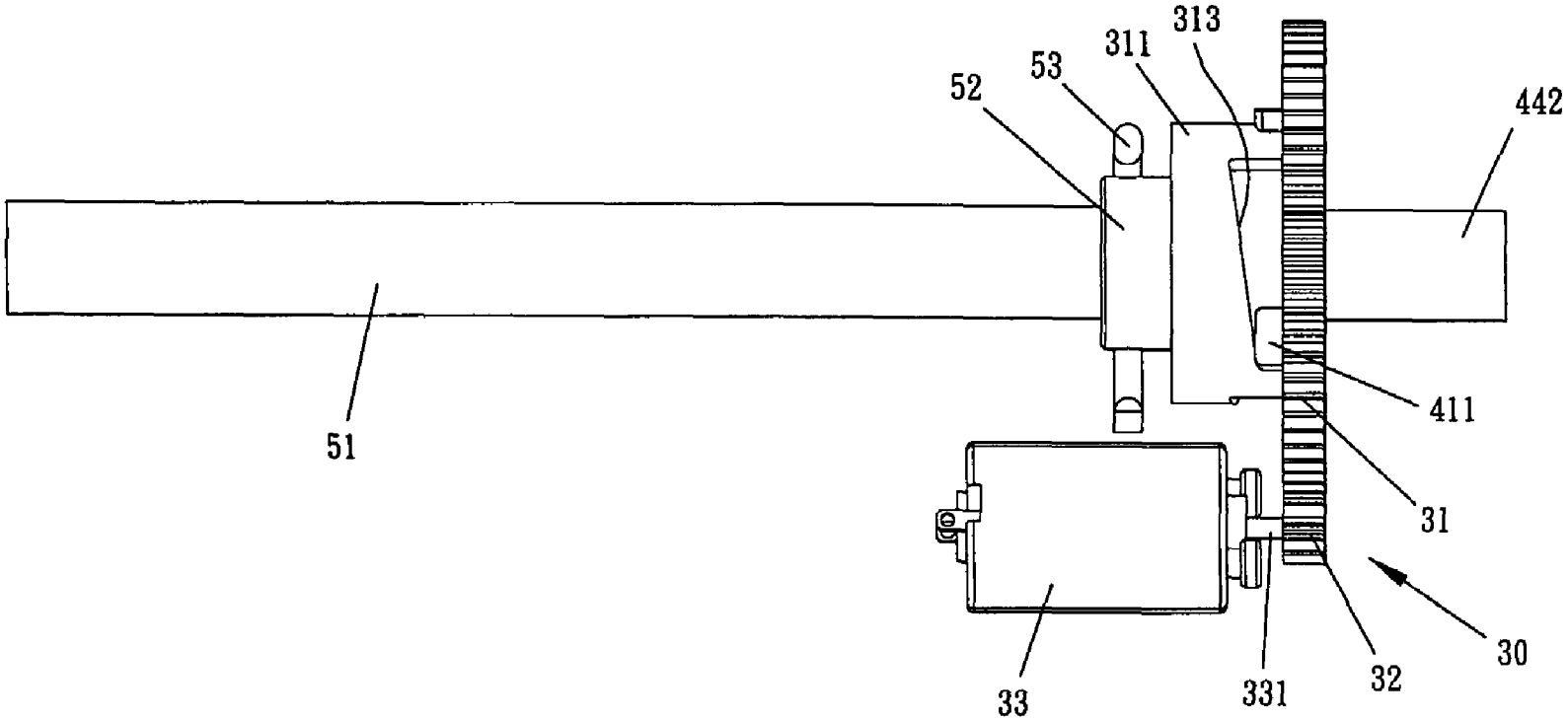
FIG. 8 is a view similar to FIG. 7 schematically showing the mechanism being in an unlocked state.

Referring to FIGS. 1 to 8, an electronic lock 1 in accordance with a preferred embodiment of the invention is shown. The lock 1 is adapted to mount in a door. The lock 1 comprises an outer handle 3, an inner handle 4, a mechanism 2 as the subject of the invention, and a latch bolt 11 operatively connected to the mechanism 2.

The mechanism 2 comprises a housing 20, a drive assembly 30, and a clutch 40. Each component is discussed in detail below.

The housing 20 comprises a case 21 and a cover 22 threadedly secured to the case 21. The case 21 comprises a large first compartment 211 and a small second compartment 212 below the first compartment 211. The drive assembly 30 is assembled in the compartments 211, 212.

The drive assembly 30 comprises a large gearwheel 31, a small pinion 32 in mesh with the gearwheel 31, and a drive source (e.g., motor) 33 partially mounted in the second compartment 212 and having a drive shaft 331 operatively connected to the central opening of the pinion 32. The gearwheel 31 and the pinion 32 are mounted in the first compartment 211. The gearwheel 31 has a front peripheral flange 311 on one surface. A plurality of equally spaced openings 312 are formed around the flange 311. Each opening 312 has a curved edge 313 between the front end of the flange 311 and the teeth of the gearwheel 31.

The clutch 40 comprises a ring 41, a first bearing sleeve 42, a coil spring 43, and a driven member 44. The ring 41 comprises a plurality of equally spaced risers 411 formed therearound. The risers 411 are disposed in the openings 312 to slidably urge against the curved edges 313. The first bearing sleeve 42 is partially disposed in the ring 41. The first bearing sleeve 42 comprises a central opening 421 of square section and a cross projection 422 on the surface facing the driven member 44. The coil spring 43 is put on the first bearing sleeve 42. The driven member 44 has a cross groove 411 on its front surface (not numbered) and a rear first spindle 442 of square section projecting through the cover 22 to secure to the inner handle 4 so that the inner handle 4 and the driven member 44 can corotate. Also, the spring 43 is biased between the front surface of the first bearing sleeve 42 and the front surface of the driven member 44 to urge the front surface of the driven member 44 against the inner surface of the cover 22 and urge the first bearing sleeve 42 against a front, inner peripheral shoulder of the ring 41. Thus, the first bearing sleeve 42 is partially disposed in the ring 41.

There are further provided a second bearing sleeve 52 including a central opening (not numbered) of square section and a rear peripheral flange 521 sandwiched between the first bearing sleeve 42 and the front surface of the first compartment 211; a front second spindle 51 of square section having a rear through hole 511, the second spindle 51 passing through the second bearing sleeve 52, the gearwheel 31, and the ring 41 into the first bearing sleeve 42 to dispose proximate the bottom of the central opening 421 of the first bearing sleeve 42; and a pin 53 inserted through a top hole (not numbered) of the second bearing sleeve 52, the through hole 511 of the second spindle 51, and a bottom hole (not numbered) of the second bearing sleeve 52 to secure the second bearing sleeve 52 and the second spindle 51 together and also secure the second bearing sleeve 52 and the first compartment 211 together.

A unlocking operation of the invention will be described in detail below by referring to FIGS. 5 to 8 specifically. The drive source 33 will be activated to turn the pinion 32 after entering a correct password. And in turn, the gearwheel 31 turns. As a result, the risers 411 are pushed rearward from the position shown in FIG. 7 to the position shown in FIG. 8 by sliding along the slowly rotating curved edges 313 until being stopped at the other ends of the curved edges 313. At the same time, the ring 41 moves rearward to push the projection 422 from the position shown in FIG. 5 to the position shown in FIG. 6 (i.e., the projection 422 moving to fit into the groove 441) with the spring 43 being compressed. Thus, the first bearing sleeve 42 and the driven member 44 can corotate. That is, turning the outer handle 3 by the hand will cause the inner handle 4 to rotate same and activate a latching solenoid (not shown) of the mechanism to retract the latch bolt 11 out of the mortise (not shown) in a door frame (not shown). As a result, the lock is unlocked.

A locking operation of the invention will be described in detail below also by referring to FIGS. 5 to 8 specifically. After unlocking the lock, the drive source 33 will be activated to turn the pinion 32 in a direction opposing to that described in opening the lock. And in turn, the gearwheel 31 turns. As a result, the risers 411 are pushed forward from the position shown in FIG. 8 to the position shown in FIG. 7 by sliding along the slowly rotating curved edges 313 until being stopped at one ends of the curved edges 313. At the same time, the ring 41 moves forward to cause the projection 422 to clear the groove 441 (i.e., from the position shown in FIG. 6 to the position shown in FIG. 5) with the spring 43 being expanded. Thus, the first bearing sleeve 42 and the driven member 44 are disengaged. That is, turning the outer handle 3 by the hand will not rotate the inner handle 3. As such, the latch bolt 11 cannot be actuated to retract out of the mortise. As a result, the door is locked.

While the invention herein disclosed has been described by means of specific embodiments, numerous modifications and variations could be made thereto by those skilled in the art without departing from the scope and spirit of the invention set forth in the claims.

What is claimed is:

1. An electronic lock comprising an outer handle (3), an inner handle (4), and a mechanism (2) comprising:

a housing (20);

a drive assembly (30) disposed in the housing (20) and comprising a gearwheel (31) including a front peripheral flange (311) and a plurality of equally spaced openings (312) around the flange (311), each opening (312) having a curved edge (313) between the front end of the flange (311) and the teeth of the gearwheel (31);

a clutch (40) disposed in the housing (20) and comprising a ring (41) including a plurality of equally spaced risers (411), the risers (411) being disposed in the openings (312) to engage with the curved edges (313), a first bearing sleeve (42) disposed in the ring (41) and including a central opening (421) of a predetermined section and a rear projection (422) of a predetermined shape, a driven member (44) including a groove (411) on its front surface, the groove (411) having a shape conformed to the predetermined shape of the projection (422) and being disengaged from the projection (422) when the electronic lock is in a locked position, and a rear first spindle (442) of a predetermined section, the first spindle (442) projecting out of the housing (20) to secure to the inner handle (4), and a biasing member (43) put on the first bearing sleeve (42) and urged against the driven member (44);

a second bearing sleeve (52) comprising a rear peripheral flange (521) securely urged against the first bearing sleeve (42) and partially forwardly projecting out of the housing (20); and a front second spindle (51) of a predetermined section securely passing through the second bearing sleeve (52) into the first bearing sleeve (42) to dispose proximate the bottom of the central opening (421) of the first bearing sleeve (42);

whereby activating a drive source (33) will turn the gearwheel (31) via a pinion (32), push the risers (411) rearward by sliding along the curved edges (313), move the ring (41) rearward to fit the projection (422) into the groove (441), and compress the biasing member (43) such that turning the outer handle (3) will activate the mechanism (2) to unlock the electronic lock.

2. The electronic lock of claim 1, wherein the biasing member (43) is a coil spring.

3. The electronic lock of claim 1, wherein the predetermined section of each of the central opening (421) of the first bearing sleeve (42), the first spindle (442), and the second spindle (51) is square.

4. The electronic lock of claim 1, wherein the predetermined shape of the projection (422) is cross.

* * * * *